US009592596B2

(12) United States Patent
Schiestl

(10) Patent No.: US 9,592,596 B2
(45) Date of Patent: Mar. 14, 2017

(54) DRIVE-IN DEVICE

(71) Applicant: Hilti Aktiengesellschaft, Schaan (LI)

(72) Inventor: Ulrich Schiestl, Hohenems (AT)

(73) Assignee: Hilti Aktiengesellschaft, Schaan (LI)

( * ) Notice: Subject to any disclaimer, the term of this patent is extended or adjusted under 35 U.S.C. 154(b) by 704 days.

(21) Appl. No.: 13/713,269

(22) Filed: Dec. 13, 2012

(65) Prior Publication Data

US 2013/0161372 A1 Jun. 27, 2013

(30) Foreign Application Priority Data

Dec. 23, 2011 (DE) ..... 10 2011 089 720

(51) Int. Cl.
*B25C 1/06* (2006.01)
*B25C 1/00* (2006.01)

(52) U.S. Cl.
CPC . *B25C 1/06* (2013.01); *B25C 1/00* (2013.01)

(58) Field of Classification Search
CPC ..... B25C 1/047; B25C 1/06; B25C 1/00
USPC ..... 227/146, 132; 254/344
See application file for complete search history.

(56) References Cited

U.S. PATENT DOCUMENTS 1,244,386 A * 10/1917 Spehar ..... E02D 7/04 173/110
4,161,272 A * 7/1979 Brockl ..... B25C 1/06 227/131
4,328,871 A * 5/1982 Gluskin ..... B25B 23/141 173/178
5,069,379 A * 12/1991 Kerrigan ..... B25C 1/06 227/120
7,537,146 B2 * 5/2009 Schiestl ..... B25C 1/06 227/131
7,815,088 B2 * 10/2010 Fielitz ..... B25C 1/06 227/129
7,832,610 B2 * 11/2010 Tanimoto ..... B25C 1/06 227/131
7,870,988 B2 * 1/2011 Schiestl ..... B25C 1/06 227/131
7,992,756 B2 * 8/2011 Franz ..... B25C 1/06 227/131
8,011,441 B2 * 9/2011 Leimbach ..... B25C 1/047 173/1
8,978,953 B2 * 3/2015 Blessing ..... B25C 1/003 227/156
2010/0089963 A1 * 4/2010 Franz ..... B25C 5/15 227/8

(Continued)

*Primary Examiner* — Thanh Truong
*Assistant Examiner* — Patrick Fry
(74) *Attorney, Agent, or Firm* — Jeremy Jay

(57) ABSTRACT

In accordance with an aspect of the application, a device for the driving in of an affixing element into a substrate has an energy transfer element for the transfer of energy to the affixing element. Preferably, the energy transfer element can be moved between a starting position and a placement position, wherein the energy transfer element is located in the starting position before a driving-in process and in the placement position, after the driving-in process.

Figure 1:
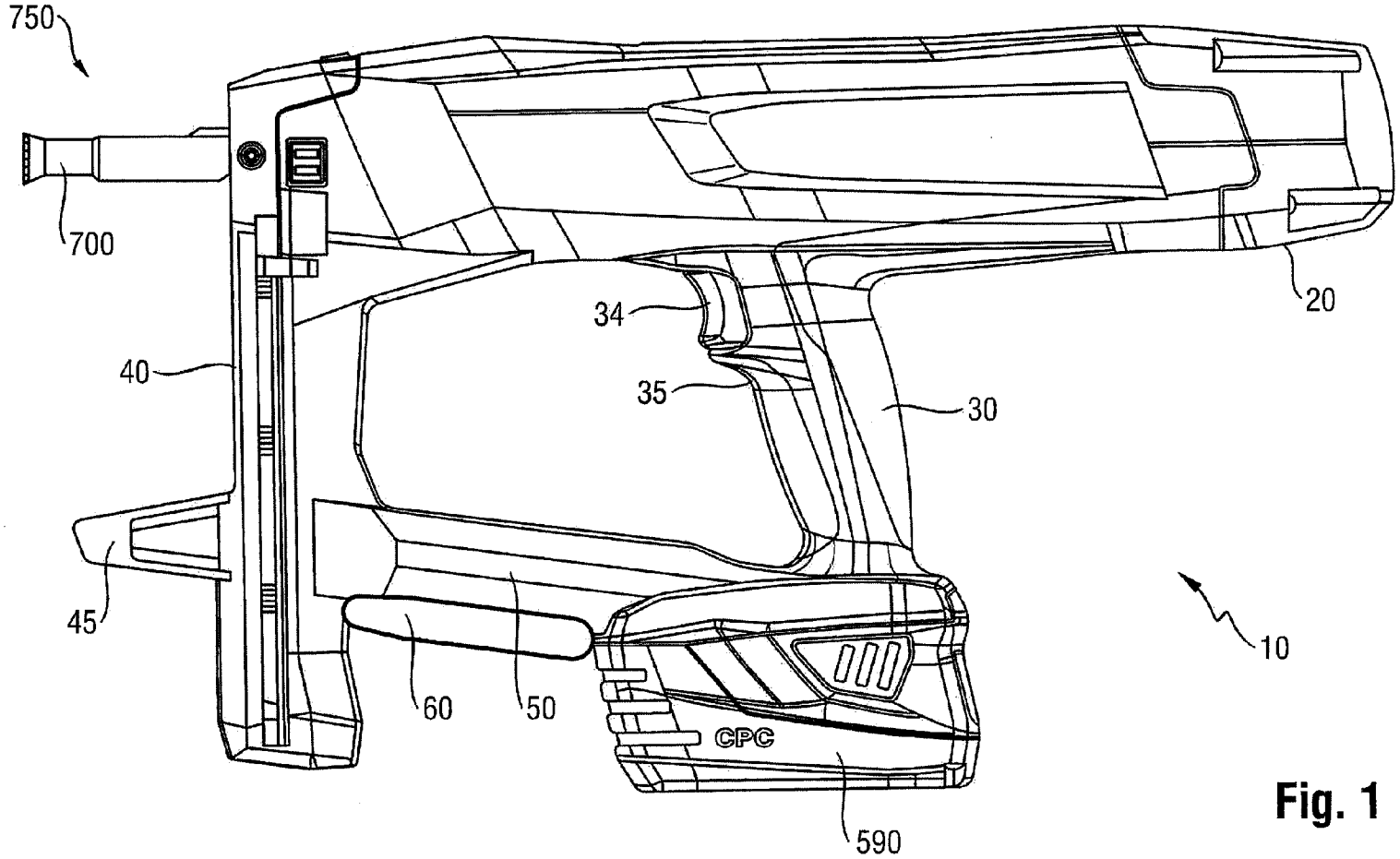

In accordance with another aspect of the application, the device comprises a mechanical energy storage unit for the storage of mechanical energy. The energy transfer element is then preferably suited for the transfer of energy from the mechanical energy storage unit to the affixing element.

18 Claims, 5 Drawing Sheets

(56) References Cited

U.S. PATENT DOCUMENTS

2011/0303728 A1* 12/2011 Franz ..... B25C 1/06
227/132

* cited by examiner

DRIVE-IN DEVICE

FIELD OF THE PRESENT INVENTION

The application concerns a device for the driving in of an affixing element into a substrate.

BACKGROUND OF THE INVENTION

Such devices usually have a piston for the transfer of energy to the affixing element. The energy needed for this must thereby be made available in a very short time, and for this reason, in so-called spring nails, for example, a spring is first placed under tension, which suddenly releases the tension energy to a piston during the drive-in process, so as to accelerate it into the affixing element.

The energy with which the affixing element is driven into the substrate is limited upwards in such devices, so that the devices cannot be used arbitrarily for all affixing elements and for any substrate. Therefore, it is desirable to make available drive-in devices which can transfer sufficient energy to an affixing element.

SUMMARY OF THE INVENTION

In accordance with one aspect of the application, a device for the driving in of an affixing element into a substrate has a mechanical energy storage unit for the storing of mechanical energy and an energy transfer element, which can move along a placement axis, between a starting position and a placement position, for the transfer of energy from the mechanical energy storage unit to the affixing element, wherein the mechanical storage unit has a first coil spring, whose helical line defines a cylinder, whose volume is located outside the placement axis.

One preferred embodiment is characterized in that the symmetry axis of the cylinder is parallel to the placement axis.

One preferred embodiment is characterized in that the energy transfer element is located in the starting position and/or in the placement position in an axial direction, at the same height as the first coil spring.

One preferred embodiment is characterized in that the mechanical energy storage unit comprises one or more other coil springs, whose helixes define a cylinder, whose volume is located outside the placement axis.

One preferred embodiment is characterized in that the first and all other coil springs are uniformly distributed around the placement axis.

In accordance with one preferred embodiment, the device has a force-absorbing element, in particular, a roll holder, to absorb the tension force of the first and at least one other coil spring.

In accordance with one preferred embodiment, the device has a guide for the force-absorbing element.

One preferred embodiment is characterized in that the force-absorbing element is provided with a particularly elastic compensation element for the first coil spring and/or the other coil spring.

One preferred embodiment is characterized in that the first coil spring has a first rotation direction, and wherein the other coil spring has a second rotation direction contrary to the first rotation direction. In this way, under certain circumstances, negative influences of the rotation direction are compensated.

In accordance with one preferred embodiment, the device has an energy transfer device to transfer energy from an energy source to the mechanical energy storage unit.

In accordance with one preferred embodiment, the device has a force transfer device to transfer a force from the energy transfer device to the mechanical energy storage unit and/or to transfer a force from the energy transfer unit to the energy transfer element.

One preferred embodiment is characterized in that the force transfer device has a force deflector to deflect the direction of a force transferred from the force transfer device.

One preferred embodiment is characterized in that the force deflector comprises a band.

One preferred embodiment is characterized in that the force deflector moves with the helix of the first and/or other coil spring.

One preferred embodiment is characterized in that the energy transfer device comprises a movement converter to convert a rotational movement into a linear movement with a rotation drive and a linear driven end, wherein the movement converter is located on the placement axis.

In accordance with one preferred embodiment, the device has a coupling device for the temporary securing of the energy transfer element in the starting position, wherein the coupling device is located on the placement axis.

In accordance with one preferred embodiment, the device has a tension rod to transfer a tension force from the energy transfer device, in particular, the linear driven end and/or the rotation driven end on the coupling device, wherein the tension rod is located on the placement axis.

One preferred embodiment is characterized in that the force transfer device, in particular, the force deflector, in particular, the band on the energy transfer device, in particular, the linear driven end is affixed.

One preferred embodiment is characterized in that the energy transfer device is suitable for the conveyance of the energy transfer element from the placement position to the starting position.

In accordance with an aspect of the application, a device to drive in an affixing element into a substrate has a mechanical energy storage unit for the storage of mechanical energy and an energy transfer device for the transfer of energy from an energy source to the mechanical energy storage unit, wherein the energy transfer device comprises a first energy supply device for the transfer of energy from an energy source to the mechanical energy storage unit and a second energy supply device, different from the first energy supply device, for the transfer of energy from the energy source to the mechanical energy storage unit.

In accordance with one preferred embodiment, the device has an energy transfer element, which can move along a placement axis between the starting position and a placement position, for the transfer of energy from the mechanical energy storage unit to the affixing element.

One preferred embodiment is characterized in that the energy transfer device comprises a force transfer device for the transfer of a force from the energy storage unit to the energy transfer element and/or for the transfer of a force from the energy transfer device, in particular, from the first and/or second energy supply device, to the mechanical energy storage unit.

One preferred embodiment is characterized in that the energy transfer device comprises a force deflector, wherein, in particular, the force deflector comprises a band or a cable line.

One preferred embodiment is characterized in that the first energy supply device is suitable for conveyance of the energy transfer element from the placement position to the starting position.

One preferred embodiment is characterized in that the second energy supply device is suitable for transferring energy to the mechanical energy storage unit and/or to derive energy from the mechanical energy storage unit, without moving the energy transfer element.

One preferred embodiment is characterized in that the energy transfer device comprises a carrying element, which can be brought to engage with the energy transfer element for the movement of the energy transfer element from the placement position to the starting position.

One preferred embodiment is characterized in that the energy transfer device comprises an engine with an engine driven end, wherein, in particular, the engine is a component of the first and the second energy supply device.

One preferred embodiment is characterized in that the energy transfer device comprises a torque transfer device to transfer a torque from the engine driven end, wherein, in particular, the torque transfer device is a component of the first and the second energy supply devices.

One preferred embodiment is characterized in that the torque transfer device comprises a gear with a gear unit output, a first gear unit output, and a second gear unit output, wherein, in particular, the first gear unit output is a component only of the first energy supply device; the second gear unit output, a component only of the second energy supply device; and the gear drive, a component of the first and the second energy supply device.

One preferred embodiment is characterized in that the gear comprises a planetary gear, wherein, in particular, the gear drive is formed by the sun gear of the planetary gear; the first gear unit output, by a ring gear of the planetary gear; and the second gear unit output, by a planet pinion of the planetary gear.

A preferred embodiment is characterized in that the first and/or the second gear unit output has a locking brake and/or a free wheel.

A preferred embodiment is characterized in that the first energy supply device comprises a movement converter to convert a rotational movement into a linear movement with a rotation driven end, which can be driven by the engine, and a linearly movable linear driven end, wherein, in particular, the rotation driven end is formed by the first gear unit output.

A preferred embodiment is characterized in that the rotation driven end comprises a toothed wheel and the linear driven end, a toothed rack.

One preferred embodiment is characterized in that the linear driven end comprises the carrying element.

One preferred embodiment is characterized in that the energy transfer element can be driven linearly by the linear driven end or forms the linear driven end.

One preferred embodiment is characterized in that the force transfer device comprises a winding roll to wind the force deflector, wherein the winding roll can be driven for the transfer of energy onto the mechanical energy storage unit from the second energy supply device, in particular, from the second gear unit output.

One preferred embodiment is characterized in that the mechanical energy storage unit is provided for the purpose of storing potential energy, and in particular, comprises a spring, in particular, a coil spring.

One preferred embodiment is characterized in that two ends of the spring, in particular, opposite ends, can be moved, so as to put the spring under tension.

One preferred embodiment is characterized in that the spring comprises two spring elements which are at a distance from one another, and, in particular, are mutually supported.

In accordance with an aspect of the application, a device for the driving in of an affixing element into a substrate has an energy transfer element, which can be moved along a placement axis between a starting position and a placement position, to transfer energy to the affixing element, and an energy transfer device for the conveyance of the energy transfer element from the placement position to the starting position, wherein the energy transfer device comprises a carrying spring and a carrying element, which can be brought to engage with the energy transfer element for the movement of the energy transfer element from the placement position to the starting position, and which can be reset, before a movement of the energy transfer element from the starting position to the placement position, by means of a force of the carrying spring.

One preferred embodiment is characterized in that the carrying element can be moved at a higher speed, during a resetting by means of the force of the carrying spring, than the movement of the energy transfer element from the placement position to the starting position.

One preferred embodiment is characterized in that the carrying element for the movement of the energy transfer element from the placement position to the starting position is to be moved against the resetting force of the carrying spring.

In accordance with one preferred embodiment, the device has a mechanical energy storage unit for the storing of mechanical energy, wherein, in particular, the mechanical energy storage unit is a potential energy storage unit and, in particular, is designed as a spring.

One preferred embodiment is characterized in that the conveyance of the energy transfer element from the placement position to the starting position is used for a transfer of energy to the mechanical energy storage unit.

One preferred embodiment is characterized in that the device comprises a coupling device for the temporary holding of the energy transfer element in the starting position, wherein the coupling device is suitable for the temporary holding of the energy transfer element, in particular, Only in the starting position.

One preferred embodiment is characterized in that the coupling device is located on the placement axis or essentially symmetrically around the placement axis.

One preferred embodiment is characterized in that the carrying element can be reset by the power of the carrying spring, whereas the energy transfer element is held in the starting position by the coupling device.

One preferred embodiment is characterized in that the carrying element lies close to the energy transfer element only.

One preferred embodiment is characterized in that the carrying element has a longitudinal body, in particular, a rod.

One preferred embodiment is characterized in that the energy transfer device comprises a linearly movable linear driven end, which comprises the carrying element and is connected with the force transfer device.

In accordance with an aspect of the application, a device for the driving in of an affixing element into a substrate has a mechanical energy storage unit for the storing of mechanical energy and an energy transfer device for the transfer of energy from an energy source to the mechanical energy storage unit, wherein the energy transfer device comprises a tension element that can move between a tension-release position and a tension position, wherein the tension element can move at a higher speed on the way from the tension position to the tension-release position than on the way from the tension-release position to the tension position.

One preferred embodiment is characterized in that the tension element for the transfer of energy on the mechanical energy storage unit can be moved from the tension-release position to the tension position.

One preferred embodiment is characterized in that the energy transfer device comprises an engine for the propulsion of the tension element.

One preferred embodiment is characterized in that during the propulsion of the tension element, on the way from the tension position to the tension-release position, the engine moves at the same speed as during the propulsion of the tension element on the way from the tension-release position to the tension position.

One preferred embodiment is characterized in that the energy transfer device comprises a clutch gearbox with a clutch gearbox drive and a clutch gearbox output, wherein the clutch gearbox output drives or forms the tension element.

One preferred embodiment is characterized in that the clutch gearbox drive can be driven by the engine.

One preferred embodiment is characterized in that the tension element can be moved back and forth linearly between the tension-release position and the tension position.

In accordance with one preferred embodiment, the device has an energy transfer element that can be moved along a placement axis between a starting position and a placement position, for the transfer of energy from the mechanical energy storage unit to the affixing element.

One preferred embodiment is characterized in that the energy transfer element is conveyed from the placement position to the starting position, if the tension element is moved from the tension-release position to the tension position.

One preferred embodiment is characterized in that the energy transfer element is conveyed from the placement position to the starting position, if the tension element is moved from the tension position to the tension-release position.

One preferred embodiment is characterized in that the energy transfer device comprises an carrying element, embraced or moved by the tension element, which can be brought to engage with the energy transfer element, for the movement of the energy transfer element from the placement position to the starting position.

One preferred embodiment is characterized in that the carrying element is reset, if the tension element is moved from the tension-release position to the tension position.

One preferred embodiment is characterized in that the carrying element is reset, if the tension element is moved from the tension position to the tension-release position.

One preferred embodiment is characterized in that the mechanical energy storage unit is provided for the purpose of storing potential energy, and, in particular, comprises a spring, in particular, a coil spring.

In accordance with an aspect of the application, a device to drive in an affixing element into a substrate has an energy transfer element for the transfer of energy to the affixing element. The energy transfer element can preferably be moved between a starting position and a placement position, wherein the energy transfer element is found in the starting position before a driving-in process and is in the placement position after the driving-in process.

In accordance with an aspect of the application, the device comprises a mechanical energy storage unit for the storing of mechanical energy. The energy transfer element is then preferably suited for the transfer of energy from the mechanical energy storage unit to the affixing element.

In accordance with an aspect of the application, the device comprises an energy transfer device for the transfer of energy from an energy source to the mechanical energy storage unit. Preferably, the energy for a driving-in process is intermediately stored in the mechanical energy storage unit, so as to be able to suddenly release it to the affixing element. Preferably, the energy transfer device is suitable for the conveyance of the energy transfer element from the placement position to the starting position. Preferably, the energy source is especially an electrical energy storage unit, with particular preference, a battery or a storage battery. Preferably, the device has an energy source.

In accordance with an aspect of the application, the energy transfer device is suitable for the purpose of conveying the energy transfer element from the placement position in the direction of the starting position, without transferring energy to the mechanical energy storage unit. This makes it possible for the absorption and/or release of the energy by the mechanical energy storage unit, without the energy transfer element moving to the placement position. The energy storage unit can therefore be unloaded, without an affixing element being driven from the device.

In accordance with an aspect of the application, the energy transfer device is suitable for the purpose of transferring energy to the mechanical energy storage unit, without the energy transfer element.

In accordance with an aspect of the application, the energy transfer device comprises a force transfer device from the energy storage unit to the energy transfer element and/or for the transfer of a force from the energy transfer device to the mechanical energy storage unit.

In accordance with an aspect of the application, the energy transfer device comprises a carrying element, which can be brought to engage with the energy transfer element for the movement of the energy transfer element from the placement position to the starting position.

Preferably, the carrying element permits a movement of the energy transfer element from the starting position to the placement position. In particular, the carrying element lies close only to the energy transfer element, so that the carrying element carries the energy transfer element only in one of two opposite movement directions.

In accordance with an aspect of the application, the energy transfer device comprises an energy supply device for the transfer of energy from an energy source to the mechanical energy source unit and a resetting device, which is separate from the energy supply device and, in particular, works independently, for the conveyance of the energy transfer element from the placement position to the starting position.

In accordance with an aspect of the application, the device comprises a coupling device for the temporary securing to the energy transfer element in the starting position. Preferably, the coupling device is suitable for the temporary securing of the energy transfer element only in the starting position.

In accordance with an aspect of the application, the device comprises an energy transfer device with a linearly movable linear driven end for the conveyance of the energy transfer element toward the coupling device, from the placement position to the starting position.

Preferably, the energy transfer element consists of a rigid body.

In accordance with an aspect of the application, the device comprises a coupling device for the temporary securing of the energy transfer element in the starting position and a tension rod for the transfer of a tension force from the energy transfer device, in particular, the linear driven end and/or the rotation drive, to the coupling device.

In accordance with an aspect of the application, the energy transfer element also comprises a coupling plug for the temporary coupling to a coupling device.

In accordance with an aspect of the application, the device comprises a delay element to delay the energy transfer element. Preferably, the delay element has a stop surface for the energy transfer element.

In accordance with an aspect of the application, the device comprises the energy source.

In accordance with an aspect of the application, the energy source is formed by an electrical energy storage unit.

BRIEF DESCRIPTION OF THE SEVERAL VIEWS OF THE DRAWING(S)

Figure 2:
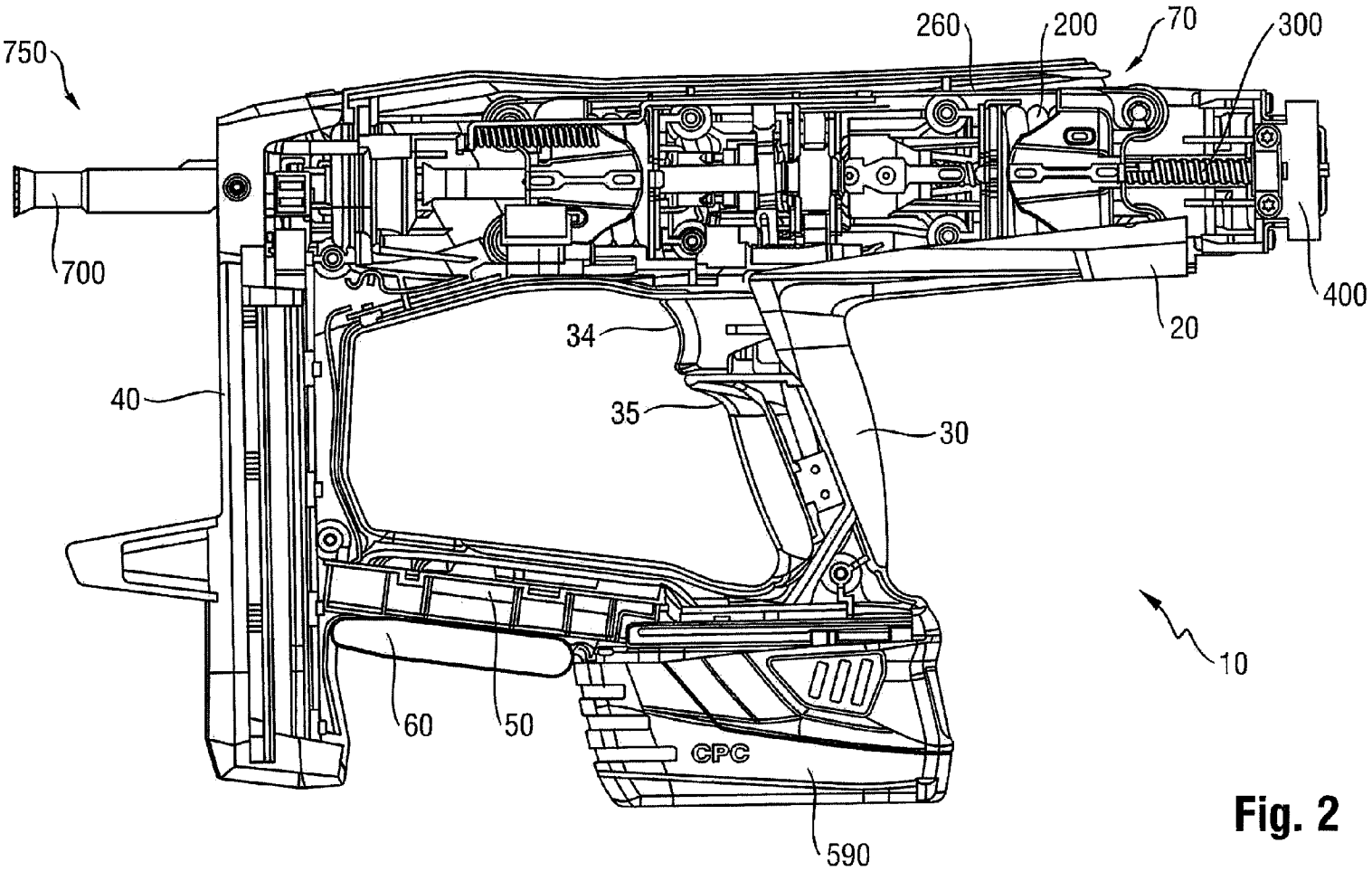
Figure 3:
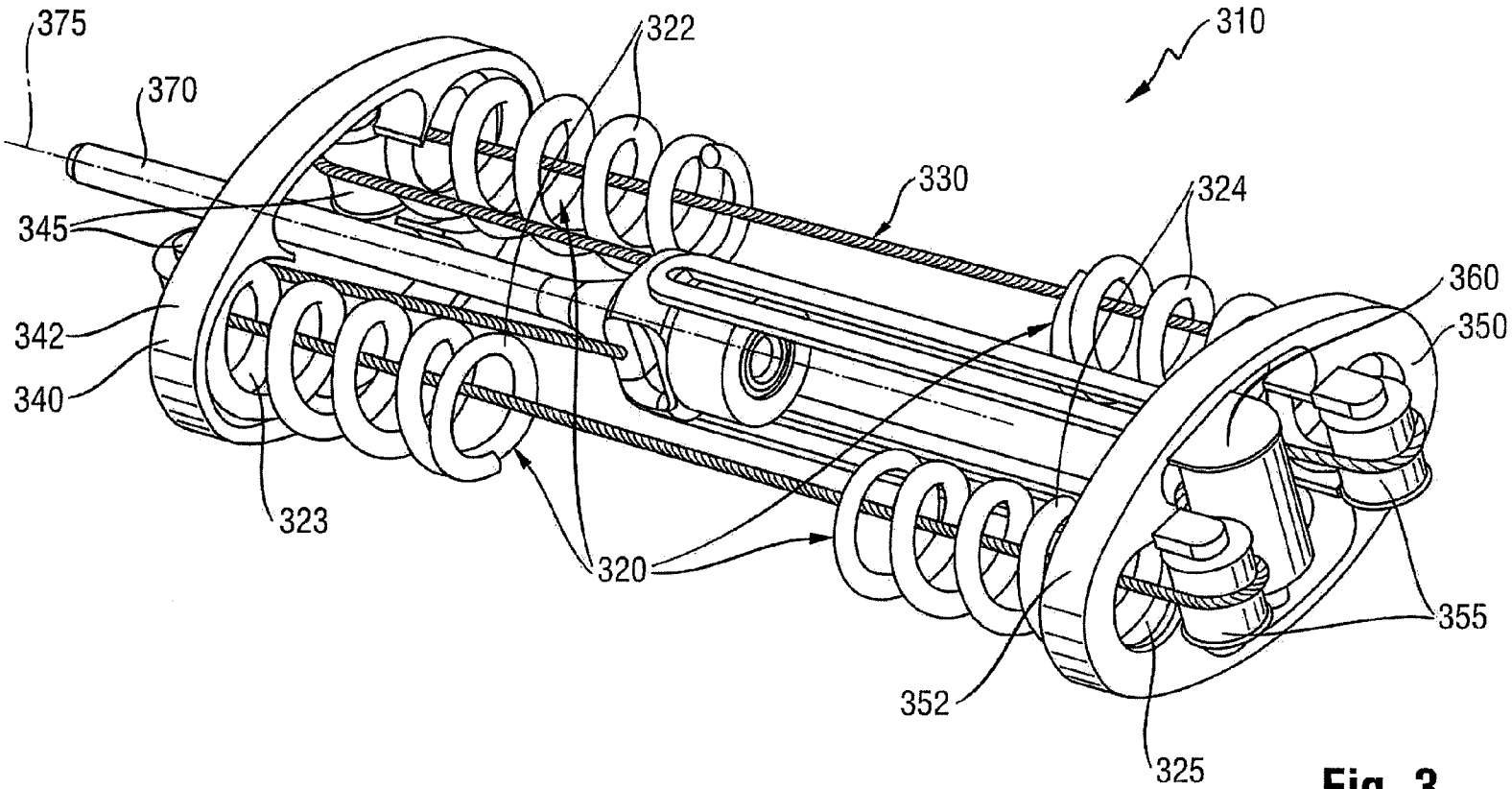

Below, embodiments of a device to drive in an affixing element into a substrate are explained, in more detail, with the aid of examples, with reference to the drawings. The figures show the following:

FIG. 1, a side view of a driving-in device;

FIG. 2, a side view of a driving-in device with an open housing;

FIG. 3, an inclined view of an energy transfer device;

FIG. 4(A-D), a schematic representation of a driving-in device;

FIG. 5(A-B), a schematic representation of a driving-in device.

DETAILED DESCRIPTION OF THE INVENTION

FIG. 1 shows a driving-in device 10 to drive in an affixing element, for example, a nail or a bolt, into a substrate in a side view. The driving-in device 10 has a nondepicted energy transfer element for the transfer of energy to the affixing element and a housing 20, in which the energy transfer element and a likewise nondepicted propulsion device for the conveyance of the energy transfer element are held.

The driving-in device 10 also has a handle 30, a magazine 40, and a bridge connecting the handle 30 with the magazine. The magazine is not detachable. Frame hooks 60 are affixed on the bridge 50, for the hanging of the driving-in device 10 on a frame or the like and an electrical energy storage unit, designed as a storage battery 590. A trigger 34 and a handle sensing element, designed as a hand switch 35, are located on the handle 30. Furthermore, the driving-in device 10 has a guidance channel 700 for guiding the affixing element and a contact device 750 for detecting a distance of the driving-in device 10 from a nondepicted substrate. An alignment of the driving-in device, vertical to a substrate, is supported by an aligning aid 45.

FIG. 2 shows the driving-in device 10 with an open housing 20. A propulsion device 70 for the conveyance of an energy transfer element, covered in the drawing, is held in the housing. The propulsion device 70 comprises a nondepicted electrical engine for the conversion of electrical energy from the storage battery 590 into rotation energy, a torque transfer device, comprising a gear 400, for the transfer of a torque of the electrical engine to a movement converter, designed as a worm drive 300, a force transfer device, comprising a pulley block 260, for the transfer of a force from the movement converter to a mechanical energy storage unit, designed as a spring 200, and for the transfer of a force from the spring to the energy transfer element.

FIG. 3 shows a force transfer device, designed as a pulley block 310, for the transfer of a force to a spring 320 in an inclined view. The pulley block 310 has a force deflector, formed by a band 330, and a front roll holder 340 with front rollers 345 and a back roll holder 350 with back rolls 355. The roll holders 340, 350 are preferably made, in particular, of a fiber-reinforced plastic. The roll holders 340, 350 have guidance tracks 342, 352 for a guidance of the roll holders 340, 350 in a nondepicted housing of the driving-in device, in particular, in grooves of the housing, wherein a possible tilting is prevented. The band 330 engages with a carrying element 360 and a piston 370 and is placed over the rollers 345, 355, so that the pulley block 310 is formed. The piston 370 is coupled and held in a nondepicted coupling device. The piston can basically move back and forth, along a placement axis 375, on which, preferably, the coupling device is located.

Furthermore, a spring 320 is shown, which comprises two front spring elements 322 and two back spring elements 324. The front spring ends 323 of the front spring elements 322 are held in the front roll holder 340, whereas the back spring ends 325 of the back spring elements 324 are held in the back roll holders 350, so that forces of the spring elements 322, 324 can be absorbed by the roll holders 340, 350. The spring elements 322, 324 are supported on their sides, facing each other, on nondepicted support rings. By the symmetrical arrangement of the spring elements 322, 324, recoil forces of the spring elements 322, 324 are cancelled, so that the operating comfort of the driving-in device is improved. The pulley block brings about a step-up of a relative speed of the spring ends 323,325 to a speed of the piston 370 by a factor of two—that is, a step-up of a speed of each of the spring ends 323,325 to a speed of the piston 370 by a factor of four.

Each of the spring elements 322, 324 is designed as a coil spring, whose helix defines a cylinder, whose volume is located outside the placement axis and whose symmetry axis runs parallel to the placement axis, wherein the front spring elements 322, with reference to the placement axis 375, are located opposite one another. Likewise, the back spring elements 324 are located on opposite sides of the placement axis 375. In an axial direction 375, the energy transfer element 370 is located at the same height as the front spring elements 322. The band 330 runs within the spring elements 322, 324, or the cylinders defined by them, wherein a space savings is made possible. For the compensation of manufacturing tolerances, with the length of the individual spring elements 322, 324, the roll holders 340, 350 are provided with nondepicated compensation elements.

FIGS. 4 and 5 each have a schematic representation of a driving-in device 410 with a nondepicted mechanical energy storage unit for the storage of mechanical energy and an energy transfer device 420 for the transfer of energy from a nondepicted energy source to the mechanical energy storage unit. The driving-in device 410 has an energy transfer element 440, which can move along a placement axis 430 between a starting position and a placement position, for the transfer of energy from the mechanical energy storage unit to a nondepicted affixing element. Preferably, the mechanical energy storage unit is designed as a spring, wherein two ends of the spring, opposite one another, can be moved with the aid of roll holders 425, so as to bring the spring under tension. Preferably, the spring thereby comprises two spring elements, which are at a distance from one another and, in particular, mutually supported.

The energy transfer device 420 has a first energy supply device 610 for the transfer of energy from an energy source to the mechanical storage unit and a second energy supply device 620, different from the first energy supply device, for the transfer of energy from the energy source to the mechanical energy storage unit. The first and the second energy supply devices together comprise a force deflector, designed as band 550, an engine 630 with an engine driven end 640, and a gear input, designed as a sun wheel 460, of a planetary gear 450 of a torque transfer device 650, which is not further depicted.

The first energy supply device also comprises a first gear unit output, designed as a planetary wheel 470 of the planetary gear 450, a free wheel 670, a carrying element 490, and a movement converter, for the conversion of a rotational movement into a linear movement with a rotation drive, formed by the planetary wheel 470, and a linearly movable linear driven end, which comprises a toothed rack 520, which is formed on carrying element 490. The first energy supply device is used for the conveyance of the energy transfer element from the placement position to the starting position.

Furthermore, the energy device 420 has a carrying spring 510, with whose force the carrying element resets, as soon as, during a tension process, the energy transfer element 440 is secured by a coupling device 530 and the carrying element is released. During the tension process, the carrying element, to this end, is moved against the reset force of the carrying spring. With the tension process, the energy transfer element is conveyed from the placement position to the starting position, so as to transfer, via a force deflector, designed as a band 550, energy to the technical energy storage unit. It is hereby sufficient if the carrying element 490 lies closely only to the energy transfer element 440, so as to transfer energy to the mechanical energy storage unit via the ring gear 480, the toothed rack 520, the carrying element 490, the energy transfer element 440, the band 550, and the roll holders 425. For this purpose, the carrying element 490 is designed as a rod with hooks.

The second energy supply device comprises, on the other hand, a second gear unit output, designed as a ring gear 480 of the planetary gear 450, a locking brake 680, and a winding roll 540 for the winding of the band 550. The second energy supply device is used for the purpose of transferring energy to the mechanical energy storage unit and deriving energy from the mechanical storage unit, without moving the energy transfer element.

Figure 4A:
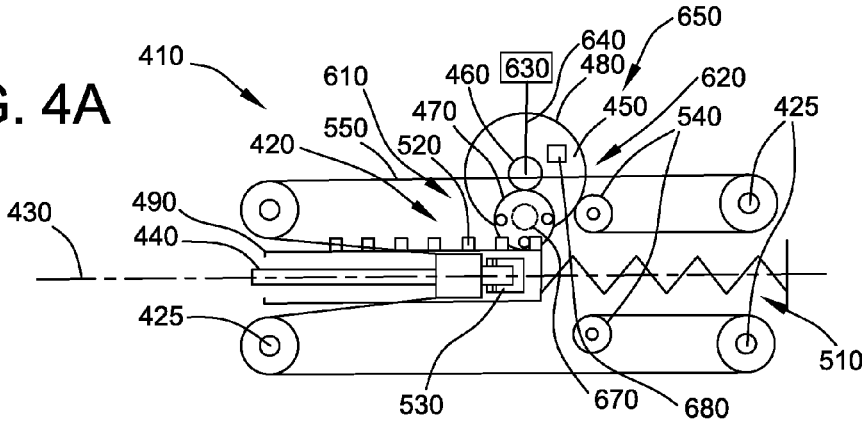
Figure 4B:
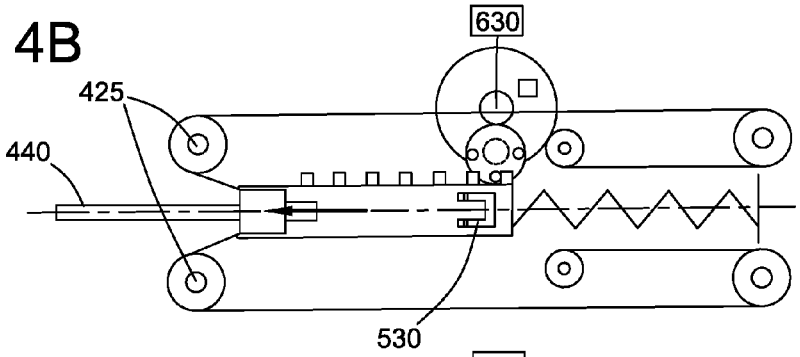
Figure 4C:
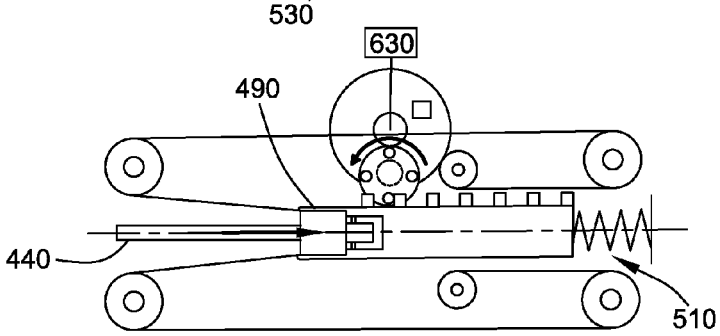
Figure 4D:
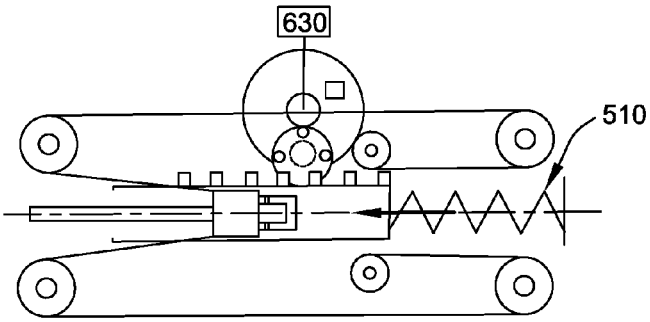

In FIGS. 4A)-4D), a normal operation cycle is shown during the driving in of an affixing element into a substrate. Left is thereby in the placement direction "front."

In FIG. 4A), the springs are under tension; the energy transfer element 440 is secured in its starting position by the coupling device 530; and the carrying element 490 is in its forefront position. After the driving-in process has been completed, the driving-in device 410 is in the position shown in FIG. 4B). The springs have had their tension released and the energy transfer element 440 is located in the placement position, in which the carrying element 490 lies closely to the energy transfer element 440. Subsequently, the energy transfer element 440 is conveyed back to the starting position, by means of the first energy supply device—that is, via the planetary wheel 470 and the carrying element 490, so as to bring the springs under tension (FIG. 4C)). As soon as the energy transfer element 440 is coupled to the coupling device 530, the carrying element 490 is released because of a missing tooth on the planetary wheel 470 and moved forwards by the carrying spring 510 (FIG. 4D)). This tooth rack driven end translates the rotational movement of the planetary gear 450 into a linear movement of the carrying element 450, wherein the gear-tooth system, at the end of the tension movement. releases the carrying element 490, as a result of the missing tooth, so that the carrying element 490, which is spring-loaded by the carrying spring 510, again springs back to the front position.

Figure 5A:
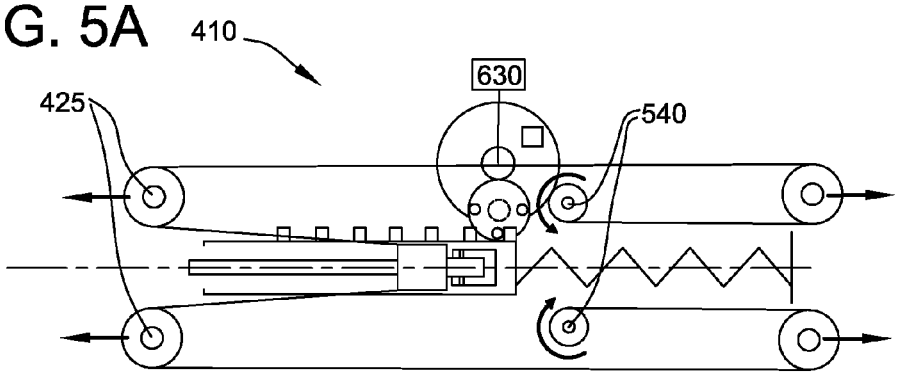
Figure 5B:
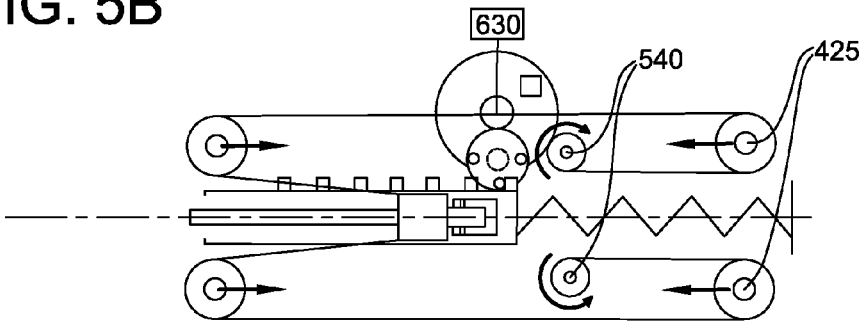

In FIGS. 5A)-5B), the tension-release and subsequent tension of the springs are shown with an energy transfer element 440, which is not moved, for example, if the driving-in device 410 is switched off and on again. Left is thereby "front" in the placement position.

As shown in FIG. 5A), the winding rolls, which are connected with one another, for this purpose, via a nondepicted gear-tooth system, are driven, in the shown direction, by the springs, whereas the locking brake 680 is released for the purpose, so that the energy is derived from the springs to the engine. The engine, in this case, serves as an engine brake. The energy transfer element 440 remains in its starting position. As soon as the driving-in device 410 is again switched on, the engine drives the winding rolls 540, in the direction shown in FIG. 5B), via the ring gear 480, so that the springs are again under tension.

The invention claimed is:

1. A device for the driving in of an affixing element into a substrate, comprising a mechanical energy storage unit for the storage of mechanical energy, an energy transfer element, moveable along a placement axis, between a starting position and a placement position, for the transfer of energy from the mechanical storage unit to the affixing element, and an energy transfer device for the transfer of energy from an energy source to the mechanical energy storage unit, wherein the energy transfer device comprises a first energy supply device for the transfer of energy from an energy source to the mechanical energy storage unit, and a second energy supply device, different from the first energy supply device, for the transfer of energy from the energy source to the mechanical energy storage unit, wherein the second energy supply device operates when the first energy supply device does not operate and the second energy supply device transfers energy to the mechanical energy storage unit, without moving the energy transfer element and/or derives energy from the mechanical energy storage unit, without moving the energy transfer element.

2. The device according to claim 1, wherein the energy transfer device comprises a force transfer device, for the transfer of a force from the mechanical energy storage unit to the energy transfer element, and/or for the transfer of a force from the energy transfer device, to the mechanical energy storage unit.

3. The device according to claim 1, wherein the first energy supply device conveys the energy transfer element from the placement position to the starting position.

4. The device according to claim 1, wherein the energy transfer device comprises a force deflector.

5. The device according to claim 1, wherein the energy transfer device comprises a carrying element, which engages with the energy transfer element, for the movement of the energy transfer element, from the placement position to the starting position.

6. The device according to claim 1, wherein the first energy supply device has a movement converter, that converts rotational movement to linear movement with a rotation drive, which is driven by the engine.

7. The device according to claim 2, wherein the force transfer device comprises a force deflector, and wherein the second energy supply device comprises a winding roll for the winding of the force deflector.

8. The device according to claim 2, wherein the force transfer device transfers force from the first and/or second energy supply device to the mechanical energy storage unit.

9. The device according to claim 4, wherein the force deflector comprises a band or a cable line.

10. A device for driving an affixing element into a substrate, comprising a mechanical energy storage unit for storing mechanical energy, an energy transfer element, movable along a placement axis, between a starting position and a placement position, for the transfer of energy from the mechanical storage unit to the affixing element, and an energy transfer device for transferring energy from an energy source to the mechanical energy storage unit, wherein the energy transfer device comprises a first energy supply device for transferring energy from an energy source to the mechanical energy storage unit, and a second energy supply device, different from the first energy supply device, for transferring energy from the energy source to the mechanical energy storage unit, wherein the second energy supply device operates when the first energy supply device does not operate and the second energy supply device transfers energy to the mechanical energy storage unit, without moving the energy transfer element and/or derives energy from the mechanical energy storage unit, without moving the energy transfer element, wherein the energy transfer device comprises an engine with an engine driven end and a torque transfer device, for transferring torque from the engine driven end, the torque transfer device comprising a gear with a gear unit input, a first gear unit output, and a second gear unit output, wherein the first and/or the second gear unit outputs have a free wheel.

11. The device according to claim 10, wherein the energy transfer device comprises a force transfer device, for the transfer of a force from the mechanical energy storage unit to the energy transfer element, and/or for the transfer of a force from the energy transfer device to the mechanical energy storage unit, wherein the force transfer device comprises a force deflector, and wherein the second energy supply device comprises a winding roll for the winding of the force deflector.

12. The device according to claim 10, wherein the energy transfer device comprises a force transfer device, for the transfer of a force from the mechanical energy storage unit to the energy transfer element, and/or for the transfer of a force from the energy transfer device to the mechanical energy storage unit, wherein the force transfer device transfers force from the first and/or second energy supply device to the mechanical energy storage unit.

13. A device for driving an affixing element into a substrate, comprising:

a mechanical energy storage unit for storing mechanical energy;

an energy transfer element, moveable along a placement axis, between a starting position and a placement position, wherein the energy transfer element transfers energy from the mechanical storage unit to the affixing element; and an energy transfer device that transfers energy from an energy source to the mechanical energy storage unit, wherein the energy transfer device comprises a first energy supply device that transfers energy from the energy source to the mechanical energy storage unit, and a second energy supply device, different from the first energy supply device, for transferring energy from the energy source to the mechanical energy storage unit, wherein the first energy supply device moves the energy transfer element from the placement position to the starting position, and wherein the second energy supply device does not move the energy transfer element.

14. The device according to claim 13, wherein the first energy supply device conveys the energy transfer element from the placement position to the starting position.

15. The device according to claim 13, wherein the second energy supply device transfers energy to the mechanical energy storage unit, without moving the energy transfer element and/or derives energy from the mechanical energy storage unit, without moving the energy transfer element.

16. The device according to claim 13, wherein the energy transfer device comprises a force transfer device, for the transfer of a force from the mechanical energy storage unit to the energy transfer element, and/or for the transfer of a force from the energy transfer device to the mechanical energy storage unit, wherein the force transfer device comprises a force deflector, and wherein the second energy supply device comprises a winding roll for the winding of the force deflector.

17. The device according to claim 13, wherein the energy transfer device comprises a force transfer device, for the transfer of a force from the mechanical energy storage unit to the energy transfer element, and/or for the transfer of a force from the energy transfer device to the mechanical energy storage unit, wherein the force transfer device transfers force from the first and/or second energy supply device to the mechanical energy storage unit.

18. The device according to claim 13, wherein the energy transfer device comprises an engine with an engine driven end and a torque transfer device, for transferring torque from the engine driven end, the torque transfer device comprising a gear with a gear unit input, a first gear unit output, and a second gear unit output, wherein the first and/or the second gear unit outputs have a free wheel.

* * * * *